United States Patent [19]

Conelly

[11] Patent Number: 4,709,440

[45] Date of Patent: Dec. 1, 1987

[54] MOBILE CLEAN-UP DEVICE

[76] Inventor: Elizabeth Y. Conelly, 2601 E. Lee St., Tucson, Ariz. 85716

[21] Appl. No.: 36,010

[22] Filed: Apr. 8, 1987

[51] Int. Cl.[4] ..... A47L 13/52; A01K 29/00

[52] U.S. Cl. ..... 15/257.3; 294/1.4

[58] Field of Search ..... 15/257.1, 257.3, 257.4, 15/257.5, 257.6, 257.8, 257.9, 79 R, 79 A, 83; 232/43.1, 43.4, 43.5; 294/19.1, 1.4

[56] References Cited

U.S. PATENT DOCUMENTS 768,871 8/1904 Albertson ..... 15/257.3

1,053,438 2/1913 Resch ..... 15/257.3

4,042,269 8/1977 Skermetta ..... 15/257.3

*Primary Examiner*—Edward L. Roberts

*Attorney, Agent, or Firm*—Richard R. Mybeck

[57] ABSTRACT

This invention relates to a mobile device for receiving and transporting debris. The device comprises a wheel mounted collector compartment having a lipped open mouth at the leading edge to receive debris, and a hinged door at the rear to discharge debris. A latch is mounted on the door to hold the door in a closed position and to release the door to allow the door to swing to an open position. The latch is controlled by a lever and cable arrangement mounted on a handle extending upward from the compartment.

19 Claims, 7 Drawing Figures

MOBILE CLEAN-UP DEVICE

INTRODUCTION

The present invention relates to a mobile device for receiving, transporting and disposing of clippings, leaves, animal droppings and like debris obtained in the course of gardening, policing and like activities directed toward the enhancement of one's environs.

BACKGROUND OF THE INVENTION

The cleaning and maintenance of both private and commercial property is an expensive and time consuming task which must be performed on a regular and continuing basis if property values are to be maintained. Such activity is also essential to the presentation of clean appearance to one's own property as well as neighborhoods in which one lives and works. Many home and apartment owners prefer to accomplish such cleaning tasks themselves, both as a matter of pride and/or matter of economy.

Of particular concern in cleaning yard areas is that most require one to gather and collect the assorted debris such as leaves, grass, animal droppings and the like by using a rake or an air blower to form the debris into stacks or piles from which it can be transported to a central collection area. Presently devices or methodologies are not available to accomplish the neat and orderly transfer of such debris without over exertion which is particularly threatening to the elderly and the weekend gardener.

This lack of a readily mobile device and system to facilitate the reception, transportation and disposal of general debris while avoiding the heavy lifting heretofore required to transfer stacked debris using the cumbersome carts and baskets currently available is the desiration toward which the present invention is directed.

BRIEF SUMMARY OF THE INVENTION

The present invention relates to a mobile device for receiving, transporting and disposing of clippings, leaves, animal droppings and like debris which essentially obviates the overexertion heretofore required to completely clean and maintain one's property with the equipment currently availabe for such chores.

More particularly, the present invention comprises a wheel-mounted trapezoidal shaped collector compartment having a lipped open mouth at the leading edge thereof and a spring loaded trap door at the rear thereof to facilitate the transfer of debris from within the collector compartment into a disposal facility with a minimum of physical exertion.

Accordingly, a prime object of the present invention is to provide a readily mobile device and methods for using same which facilitates the collection, transportation and disposal of clippings, leaves, animal droppings and like debris for even the weak and the aged.

Another object of the present invention is to provide a new and improved mobile clean-up device which can be easily loaded and unloaded without having to lift and invert the entire device as has been heretofore required to unload prior art lawn carts and like devices.

A further object of the present invention is to provide a new and improved mobile device which enables leaves and trash to be directly raked thereinto and which can be easily unloaded without either stooping or bending while using same.

Still another object of the present invention is to provide a new and improved mobile device for policing lawns, gardens and the like which eliminates the need for card boards, dust pans, shovels and the human hand to pick up debris piles and transfer them to a cart for transport to a disposal site.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DETAILED DESCRIPTION OF PREFERRED EMBODIMENTS

Figure 1:
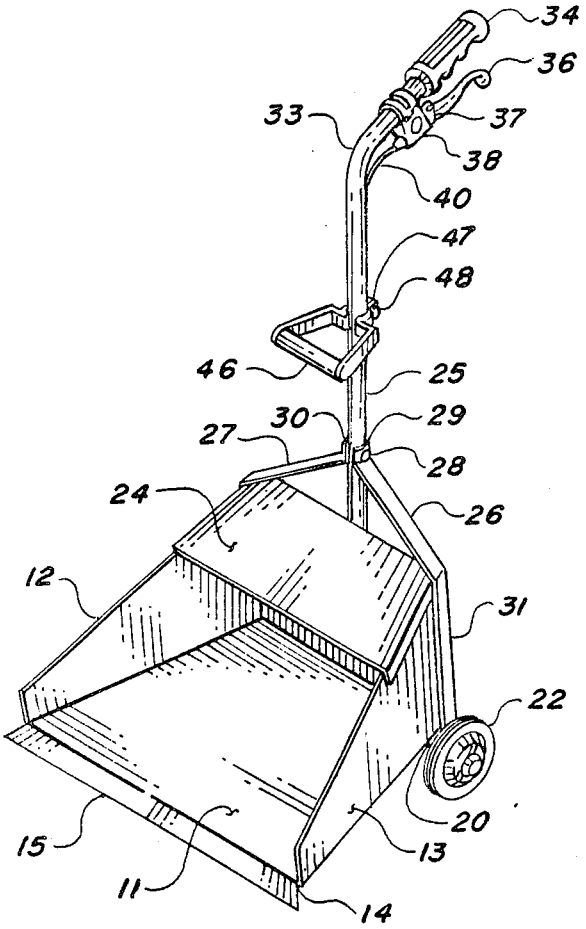
FIG. 1 is an isometric view of a mobile clean-up device embodying the present invention.
Figure 2:
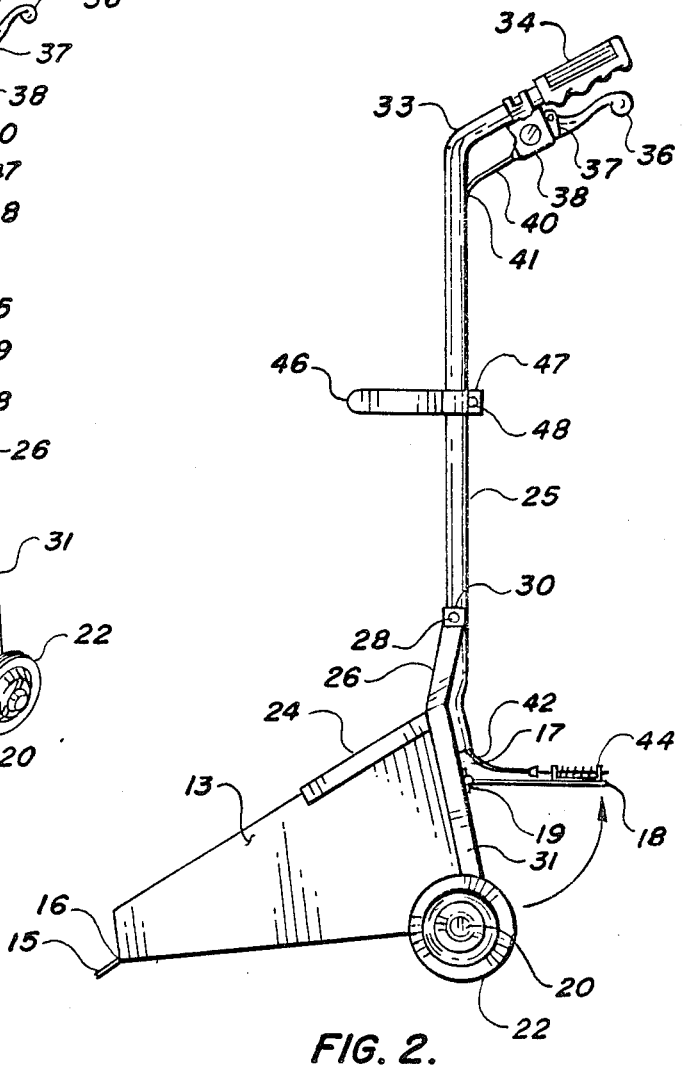
FIG. 2 is a side view of the device of FIG. 1.
Figure 3:
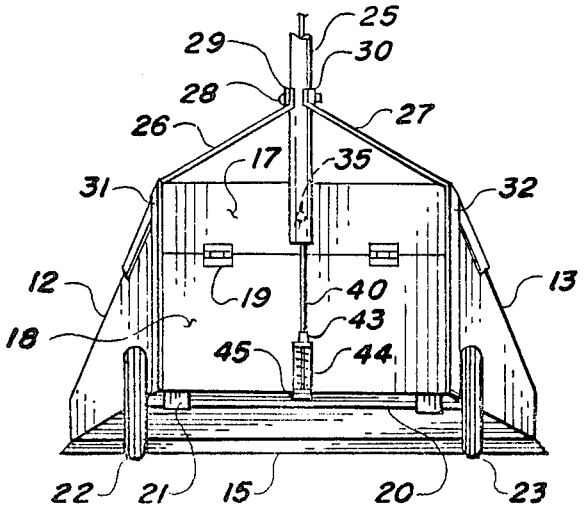
FIG. 3 is a rear view of the device of FIG. 1.
Figure 4:
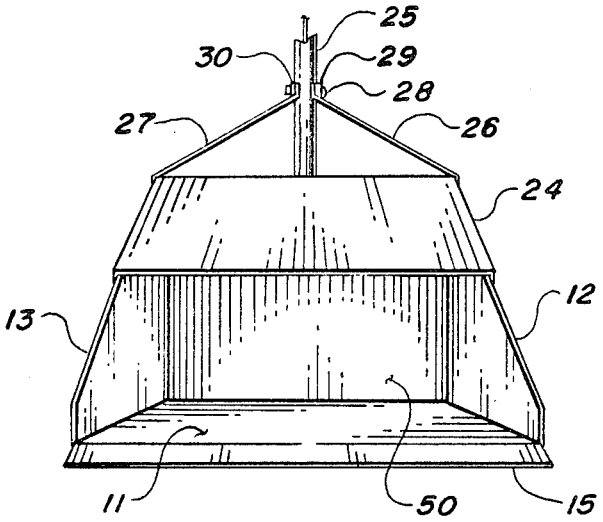
FIG. 4 is a frontal elevation, partially broken away of the device of FIG. 1.
Figure 5:
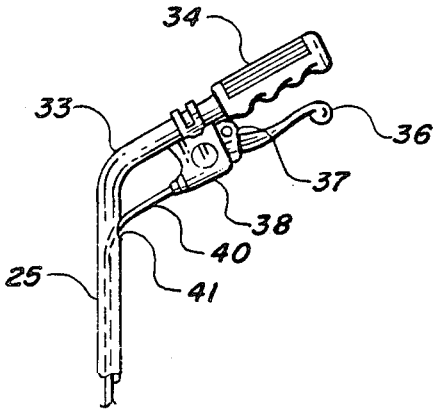
FIG. 5 is an enlarged fragmented showing of the cable actuator assembly in accordance with the present invention.
Figure 6:
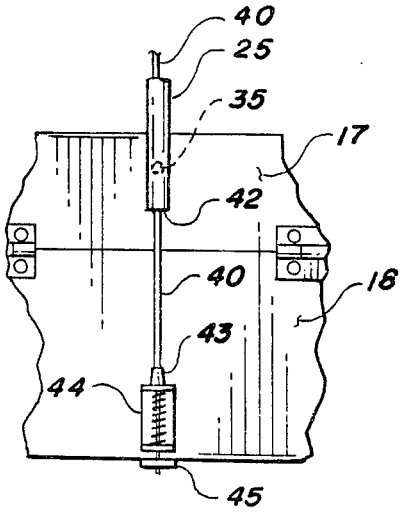
FIG. 6 is an enlarged fragmented view of the trap door and latch embodying the present invention.
Figure 7:
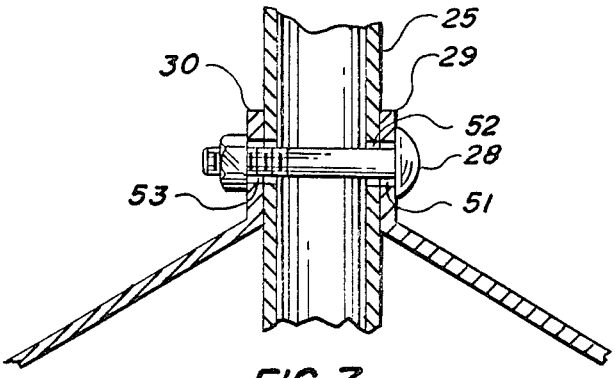
FIG. 7 is an enlarged fragmented cross-section showing the connection of handle means to associated brace members in accordance with the present invention.

Referring to the drawing, a device embodying the present invention is shown in FIGS. 1–4 and identified by the general reference 10. Each device comprises a trapezoidal shaped collector base surface 11 fabricated from a lightweight metal or high density plastic and the like having a first tapered side wall 12 extending upwardly from one edge thereof and a second tapered side wall 13 extending upwardly from the other edge thereof. Base surface 11 has a wider leading edge 14 having a semi-rigid lip 16 integrally formed therewith and extending beyond sides 12 and 13, to facilitate the raking and scooping of debris thereinto. Lip 15 is formed with or secured to bottom panel 11 along a semi-rigid seam 16 to provide some vertical movement thereto to facilitate efficient debris gathering. Sides 12, 13 are provided with an increasing vertical dimension from front to rear and is secured to rear plate 17 to accommodate a larger volume of storage after loading. A rectangular trap door 18 is secured to rear plate 17 by suitable hinge means 19 which enables trap door 18 to be pivoted thereabout in response to forces and for purposes to be hereinafter described in detail.

An axle shaft member 20 is suitably secured to the undersurface of base 11 by suitable axlemounts 21 and supports wheels 22, 23 at the extremities thereof for rotation thereabout. Wheels 22, 23 and axle 20 support base surface 11 and provide complete mobility for device 10.

A lid or cover member 24 is attached to the upper edges of side members 12 and 13 and from rear plate 17 toward the front thereof to further secure and prevent spillage of the debris collected therein during the transport thereof.

Adjacent rear plate 17 and extending orthogonally thereto is a hollow tubular handle means 25 secured in situ between a first brace means 26 operatively interposed between side member 12 and handle means 25 and a second brace means 27 operatively interposed between side member 13 and handle means 25 by the insertion of a suitable securing means such as bolt 28 through a suitable aperture 51 defined through upstanding end portion 29 of brace means 26, a complementary aperture 52 passing through handle means 25, and a corresponding aperture 53 defined through upstanding end portion 30 of brace means 27.

The lower portion 31 of brace means 26 is suitably secured or fused to side member 12 and the lower portion 32 of brace means 27 is suitably secured or fused to side member 13 to complete the structural integrity of the brace assembly.

The uppermost portion 33 of handle means 25 is angularly disposed relative to the major longitudinal axis of handle means 25 to provide a convenient area for gripping the handle which is preferably encased in handle grip 34. The lower most portion of handle means 25 is suitably secured to back plate 17 with a suitable fastener such as bolt 35.

Adjacent handle grip 34, an actuator lever 36 is pivotally attached to actuator fulcrum means 37 which is attached by a suitable bracket 38 to handle means 25. A suitable force transmitting means such as cable 40 is attached at one end thereof to lever means 36 and extends downwardly therefrom through cable ingress port 41 defined in handle means 25 adjacent portion 33 thereof into the tubular passage defined therein for exit through cable egress port 42 and attachment to a suitable cable connector 43 which is secured to for operative response of a spring latch 44 which disengages from latch detect 45 in response to the movement of lever 36 about fulcrum 37 in response to a selective external pressure placed thereupon. As will appear, the disengagement of spring latch 44 from detent 45 allows trap door 18 to fall free of its substantially vertical locked position into an open position which enables the contents of the device 10 to be readily removed therefrom with a minimum of exertion.

To facilitate dumping the contents of the device when trap door 18 is in its open position, an assist handle 46 is mounted at the middle area of handle means 25 by means of a circumscribing bracket 47 suitably secured thereto by a bolt 48 in a manner which permits assist handle 46 to be rotated on handle means 25 to any suitable position.

In use, debris is raked or otherwise drawn into device 10 across lip 15 into the storage chamber 50 defined by the cooperative coaction of brace plate 11, side plates 12 and 13, rear plate 17, trap door 18 and top cover 24.

When it is desired to relocate device, either for additional pick up or to discharge the load for refuse pick up, the device is moved on wheels 22, 23 by grasping portion 33 and at grip 34 and pushing or pulling the device 10 to its desired new location. If additional debris is to be loaded, the previously described proceedure is repeated.

If the chamber 50 is full and it is desired to empty its contents thereof into a refuse container, the operator applies pressure to lever 36 causing it to pivot on fulcrum 37 thereby shortening nylon cable 40 which in turn disengages spring loaded fastener 44 from detent 45 and allows trap door 18 to pivot open on the hinges 19 operatively associated therewith.

The device is then readily tiltable by grasping handle grip 34 and assist handle 46 and tipping the device 10 until the plate of the trap door opening is disposed over the refuse container sufficiently to exceed the angle of repose of the contained trash, which with gravity assist departs the device 10 and flows to the refuse container. When the chamber 50 is thus emptied, the trap door is closed and latching fastener 44 is reengaged within detent 45 and the collection of debris can be resumed.

Wheels 22, 23, preferably are of sufficient size to allow device 10 to tilt forward and rest on lip 15. Furthermore, wheels 22 and 23 provide a fulcrum for the entire device 10 and permit lip 15 to be raised and lowered while engaging debris to facilitate pushing the debris into chamber 50.

Handle 25 is detachably secured to rear panel 17 and secured by detachable braces 20 and bolt 28 which enables handle 25 to be quickly and easily removed for storage or shipping.

Assist handle 46 is pivotably attached to handle 25 by clamp 47 and may be positioned in any desirable location to provide the most comfortable leverage for dumping debris or to aid in the movement of device 10 when encountering rough terrain and/or heavy loads.

Handle grip 3, which is provided to prevent hand friction and possible tissue abradement, is preferably composed of soft polypropylene or rubber.

From the foregoing, it is apparent that an invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A mobile clean up device comprising a wheeled bse member having a leading edge, a trailing edge and first and second side edges; a first and second side member attached to said first and second side edges, respectively; a lip member secured to said leading edge and inclined downwardly therefrom; a rear plate secured to said trailing edge and extending upwardly therefrom; said rear plate having an upper portion rigidly secured to said side plates, a lower portion pivotally secured to said upper portion, and hinge means operatively interposed between said upper portion and said lower portion to pivot said lower portion between an open position and a closed position against said base member; latch means attached to said base member to secure said lower portion of said rear plate in said closed position; handle means detachably secured at one end thereof to said upper portion of said rear plate and extending upwardly therefrom; lever means secured to said handle means remote of said rear plate; and cable means operatively interconnected between said lever means and said latch means and responsive to movement of said lever means to disengage said latch means and permit said lower portion to move away from said base member in free pivotal movement about said hinge means in response to gravity thereupon and discharge trash from within said device.

2. A clean up device according to claim 1 in which said handle means comprises an elongated tubular member having an elongated body portion and a handle portion disposed angularly relative to said body portion and having a grip wrapped thereabout.

3. A clean up device according to claim 2 in which said latch means comprises a spring biased latch member and a detent means being cooperatively disposed relative to said detent means and reciprocable relative thereto in response to a force applied thereto, said latch member having a cable connector at one end thereof for receiving said cable means therein and transmitting the force therefrom to move said latch member relative to said detent means.

4. A clean up device according to claim 3 in which said lever means comprises a handle member having a first and second end, a fulcrum securing said handle member intermediate said first and said second end to said handle means, and a cable connector attached to said second end and movable in response to force applied to said first end, said cable means being attachable to said cable connector and responsive to the movement thereof.

5. A clean up device according to claim 4 in which said handle means comprises a cable ingress adjacent the upper portion thereof and a cable egress adjacent the lower portion thereof, said cable means extending from said lever means through said ingress into said handle means and out through said egress for connection to said latch means.

6. A clean up device according to claim 5 in which an assist handle is operatively secured to said handle means intermediate said lever means and said rear plate.

7. A clean up device according to claim 2 in which said handle means comprises a cable ingress adjacent the upper portion thereof and a cable egress adjacent the lower portion thereof, said cable means extending from said lever means through said ingress into said handle means and out through said egress for connection to said latch means.

8. A clean up device according to claim 2 in which an assist handle is operatively secured to said handle means intermediate said lever means and said rear plate.

9. A clean up device according to claim 1 in which said latch means comprises a spring biased latch member and a detent means being cooperatively disposed relative to said detent means and reciprocable relative thereto in response to a force applied thereto, said latch member having a cable connector at one end thereof for receiving said cable means therein and transmitting the force therefrom to move said latch member relative to said detent means.

10. A clean up device according to claim 9 in which said lever means comprises a handle member having a first and second end, a fulcrum securing said handle member intermediate said first and said second end to said handle means, and a cable connector attached to said second end and movable in response to force applied to said first end, said cable means being attachable to said cable connector and responsive to the movement thereof.

11. A clean up device according to claim 9 in which said handle means comprises a cable ingress adjacent the upper portion thereof and a cable egress adjacent the lower portion thereof, said cable means extending from said lever means through said ingress into said handle means and out through said egress for connection to said latch means.

12. A clean up device according to claim 9 in which an assist handle is operatively secured to said handle means intermediate said lever means and said rear plate.

13. A clean up device according to claim 1 in which said lever means comprises a handle member having a first and second end, a fulcrum securing said handle member intermediate said first and said second end to said handle means, and a cable connector attached to said second end and movable in response to force applied to said first end, said cable means being attachable to said cable connector and responsive to the movement thereof.

14. A clean up device according to claim 13 in which said handle means comprises a cable ingress adjacent the upper portion thereof and a cable egress adjacent the lower portion thereof, said cable means extending from said lever means through said ingress into said handle means and out through said egress for connection to said latch means.

15. A clean up device according to claim 13 in which an assist handle is operatively secured to said handle means intermediate said lever means and said rear plate.

16. A clean up device according to claim 1 in which said handle means comprises a cable ingress adjacent the upper portion thereof and a cable egress adjacent the lower portion thereof, said cable means extending from said lever means through said ingress into said handle means and out through said egress for connection to said latch means.

17. A clean up device according to claim 16 in which an assist handle is operatively secured to said handle means intermediate said lever means and said rear plate.

18. A clean up device according to claim 1 in which an assist handle is operatively secured to said handle means intermediate said lever means and said rear plate.

19. A clean up device according to claim 1 in which said lever means comprises a handle member having a first and second end, a fulcrum securing said handle member intermediate said first and said second end to said handle means, and a cable connector attached to said second end and movable in response to force applied to said first end, said cable means being attachable to said cable connector and responsive to the movement thereof.

* * * * *